US006302322B1

(12) United States Patent
Focke et al.

(10) Patent No.: US 6,302,322 B1
(45) Date of Patent: Oct. 16, 2001

(54) HINGED-LID BOX FOR CIGARETTES

(75) Inventors: Heinz Focke, Verden; Henry Buse, Visselhövede, both of (DE)

(73) Assignee: Focke & Co. (GmbH & Co.), Verden (DE)

( * ) Notice: Subject to any disclaimer, the term of this patent is extended or adjusted under 35 U.S.C. 154(b) by 0 days.

(21) Appl. No.: 09/423,240

(22) PCT Filed: Apr. 25, 1998

(86) PCT No.: PCT/EP98/02477

§ 371 Date: Nov. 5, 1999

§ 102(e) Date: Nov. 5, 1999

(87) PCT Pub. No.: WO98/50287

PCT Pub. Date: Nov. 12, 1998

(30) Foreign Application Priority Data

May 5, 1997 (DE) ..... 197 18 821

(51) Int. Cl.[7] ..... B65D 43/16
(52) U.S. Cl. ..... 229/160.1; 206/268; 206/273
(58) Field of Search ..... 206/268, 273; 229/160.1, 242, 256, 257, 267, 271

(56) References Cited

U.S. PATENT DOCUMENTS

| | | | | |
|---|---|---|---|---|
| 2,951,626 | * | 9/1960 | Weiss | 206/268 |
| 3,910,487 | * | 10/1975 | Jaeschke | 206/268 X |
| 4,216,898 | * | 8/1980 | Davies | 206/268 X |
| 4,236,663 | * | 12/1980 | Krautter et al. | 206/268 |
| 4,251,022 | * | 2/1981 | Focke | 206/268 |
| 4,267,958 | * | 5/1981 | Focke et al. | 206/268 X |
| 4,948,038 | * | 8/1990 | Moeller | 206/268 X |
| 5,143,282 | | 9/1992 | Pham . | |
| 5,443,202 | * | 8/1995 | Jorgensen-Beck et al. | 229/146 |
| 5,715,936 | * | 2/1998 | Focke et al. | 206/268 |
| 5,819,925 | * | 10/1998 | Brizzi et al. | 206/268 X |
| 5,896,984 | * | 4/1999 | Focke et al. | 206/268 |

FOREIGN PATENT DOCUMENTS

| | | |
|---|---|---|
| 28 13 390 | 10/1979 | (DE) . |
| 28 33 494 | 2/1980 | (DE) . |
| 37 13 612 | 11/1988 | (DE) . |
| 39 16 756 | 11/1990 | (DE) . |
| 195 22 894 | 6/1994 | (DE) . |
| 399 250 | 11/1990 | (EP) . |
| 79/00034 | 1/1979 | (WO) . |
| 96/3741 | 11/1996 | (WO) . |

* cited by examiner

*Primary Examiner*—Allan N. Shoap
*Assistant Examiner*—Tri M. Mai
(74) *Attorney, Agent, or Firm*—Sughrue, Mion, Zinn, Macpeak & Seas, PLLC

(57) ABSTRACT

A single-piece hinged-lid cigarette box which has a collar (12) connected to a main section (33), in the area of a front panel (13) of the box, by tabs (34, 35), the collar being part of the single-piece box. A front panel (30) of the collar is provided with recesses (41, 42) in order to avoid a multi-layer structure in the area of the tabs (34, 35) which are folded into a Z shape (34, 35). At least partial areas of the folded tabs (34, 35) fit into these recesses (41, 42).

9 Claims, 8 Drawing Sheets

HINGED-LID BOX FOR CIGARETTES

BACKGROUND OF THE INVENTION

The invention relates to a hinge-lid box (hinge-lid pack), in particular for cigarettes, comprising a single-piece blank made of (thin) cardboard for forming a box part with a box front wall, box rear wall, box side walls and base wall and for forming a lid with a lid front wall, lid rear wall, lid side walls and end wall, and also having a collar comprising a collar front wall and collar side tabs, the collar being connected, in the region of the collar front wall, to the box front wall via residual connections or webs which, when the blank is folded, can be folded in a Z-shaped manner such that the residual connections or webs butt against the inside of the box front wall.

Various designs are known for hinge-lid boxes comprising blanks in which the collar is connected integrally to a main blank for the box part and lid. In the case of the hinge-lid box according to EP 6 872, webs are arranged, as means for connection to the collar, on the upright sides of the box front wall. By virtue of its position relative to the box front wall being changed, said collar is folded into the pack-specific position, in which case the webs are moved into a Z-shaped folded position.

The hinge-lid box according to DE 27 59 178 is of similar configuration, the foldable connection between the box front wall and collar front wall extending over the entire width of the box front wall.

SUMMARY OF THE INVENTION

The object of the invention is to develop further, and improve, hinge-lid boxes of the above described design such that production is made easier and the outer appearance of the finished hinge-lid box is improved.

In order to achieve this object, the hinge-lid box according to the invention is characterized in that the collar front wall, which butts against the (Z-shaped) folded webs on the inside, has a cutout or depression in the region of the webs, the relevant web passing at least partially into said cutout or depression.

The hinge-lid box according to the invention is based on the finding that the residual connections or webs in the folded position, that is to say in the position between the collar front wall and box front wall, create an additional material layer and thus a thickened formation. This is wholly or partially eliminated according to the invention by virtue of the cutout or depression in the collar front wall, in the region of the folded web, with the result that the latter is at least predominantly located in the cutout and a local thickened formation in the material is thus avoided.

According to the invention, the positioning and dimensions of the cutout are adapted to the dimensioning and positioning of the web when folded. By virtue of a specific configuration of the webs, namely by virtue of a transversely directed partial cut in the region of a folding articulation, the folded web can assume a clamping position in the cutout of the collar front wall and can thus fix the folded position of the collar or of the webs.

A further special feature of the invention consists in proposing an advantageous design of the single-piece blank for a special type of hinge-lid box, namely those with rounded longitudinal edges or bevelled longitudinal edges (of octagonal cross-section).

BRIEF DESCRIPTION OF THE DRAWINGS

Further details regarding the configuration of single-piece hinge-lid boxes within the context of the invention are explained in more detail hereinbelow with reference to exemplary embodiments illustrated in the drawings, in which.

DETAILED DESCRIPTION OF THE INVENTION

Figure 2:
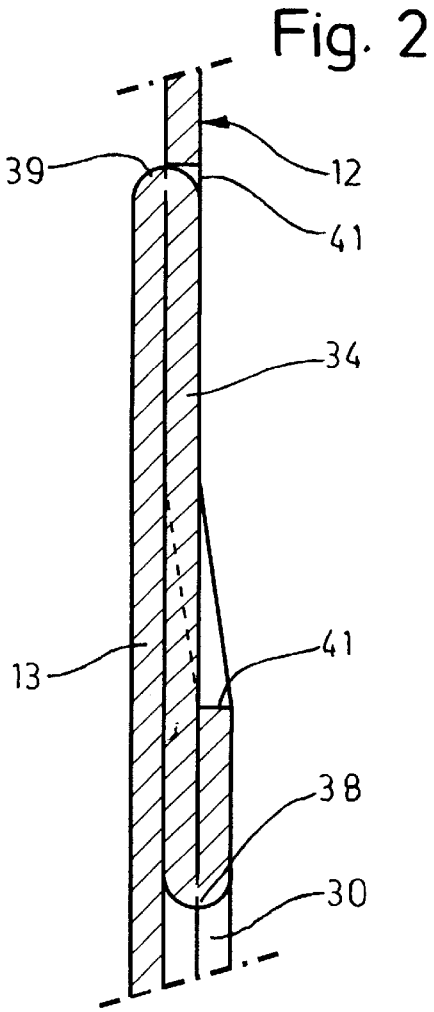
FIG. 2 shows, on a vastly enlarged scale, a detail of the hinge-lid box according to FIG. 1, namely a detail in the region of the collar, in the vertical section taken along section plane II—II of FIG. 1.

A typical hinge-lid box comprises a (relatively large) box part 10, a lid 11 and a collar 12. The box part 10 forms a box front wall 13, a box rear wall 14 and narrow, elongate box side walls 15 and 16. The box part 10 is bounded at the bottom by a base 17. Analogously to this, the lid 11 comprises lid front wall 18, lid rear wall 19, lid side walls 20, 21 and a top end wall 22. The lid 11 is connected pivotably to the box part 10, to be precise via an articulation line 23 between the box rear wall 14 and lid rear wall 19.

It is also typical of a hinge-lid box that the box side walls 15, 16 and the lid side walls 20, 21 are of double-layered design, that is to say each comprise an inner box side tab 24 and outer box side tab 25. Analogously, the lid side walls 20 and 21 are of double-layered design, that is to say comprise an inner lid side tab 26 and an outer lid side tab 27. The side tabs 24, 25 of the box part 10, on the one hand, and the side tabs 26, 27 of the lid 11, on the other hand, are separated off from one another by oblique closing edges 28, 29.

A further important constituent part of the hinge-lid box is the collar 12, with a collar front wall 30 and transversely directed collar side tabs 31 and 32. The collar 12 is seated, by way of a bottom region, in the box part 10 and is anchored in the latter. A collar top part, which projects out of the box part 10, is enclosed by the lid 11 when the hinge-lid box is in the closed position. The collar front wall 30 butts against the inside of the box front wall 13, while the collar side tabs 31, 32 butt against the box side walls 15, 16 on the inside.

The hinge-lid box as a whole, that is to say including the collar 12, comprises a single-piece blank (made of thin cardboard). The box part 10 and lid 11 form a main blank 33. The collar 12 is connected to said main blank 33 in the region of the box front wall 13, to be precise via residual connections, namely webs 34 and 35. The rectangular or strip-like webs 34 and 35 are positioned in the lateral region of the box front wall 13, on the one hand, and of the collar front wall 30, on the other hand. Each web 34, 35 is bounded in the longitudinal direction by punch cuts 36, 37. Folding lines 38, 39 extend transversely thereto. The folding line 39 which is at the bottom, or faces the box front wall 13, is located in the top boundary of the box front wall 13, that is to say in extension of a free transverse edge 40 of the box front wall 13.

Figure 3:
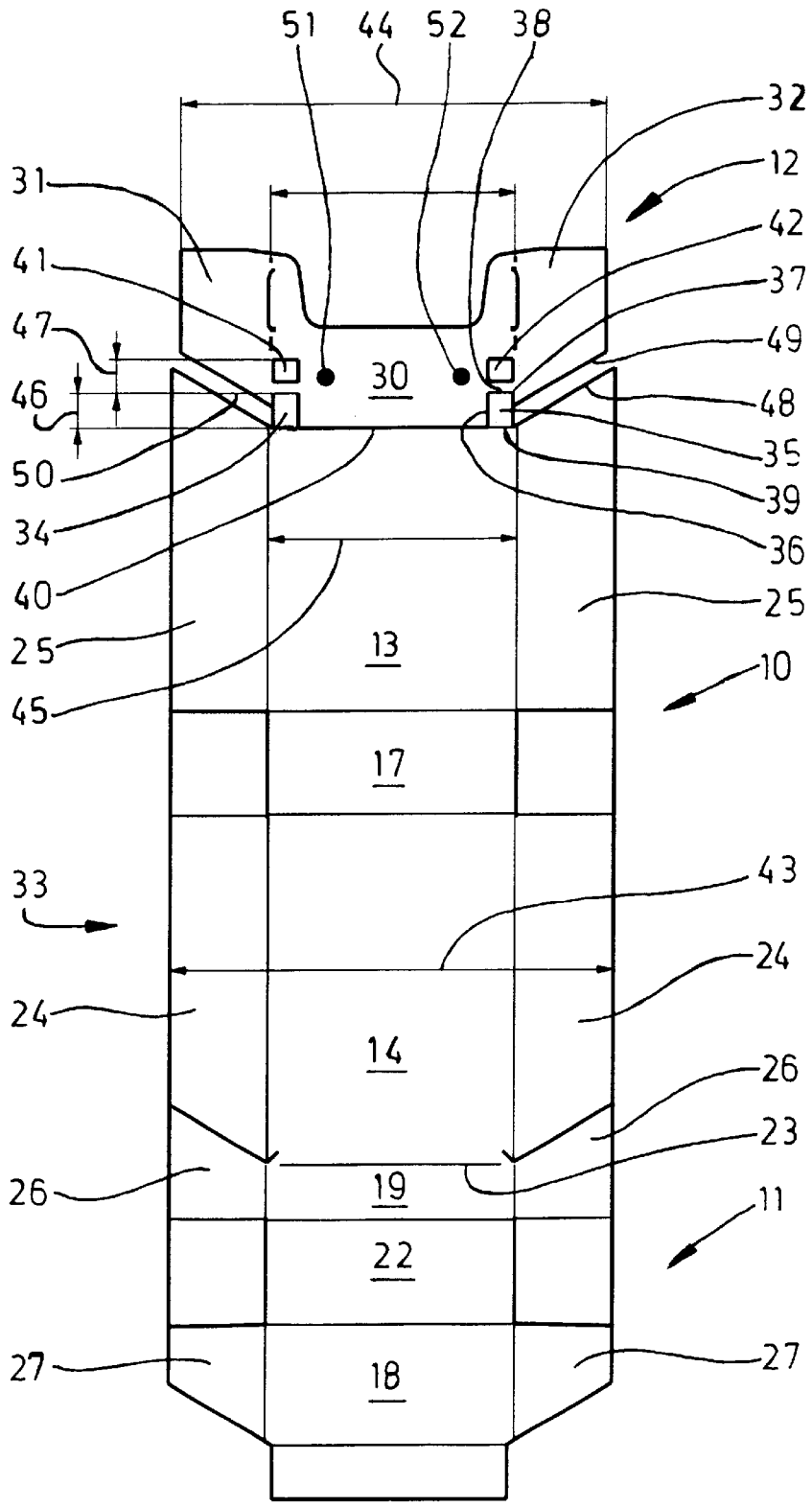
FIG. 3 shows a spread-out blank for a hinge-lid box according to FIG. 1.

When the hinge-lid box has been folded, or the collar 12 is in the pack-specific position, the latter, in relation to the spread-out position of FIG. 3, has been displaced relative to the main blank 33, to be precise in the direction of the base 17. In this process, the webs 34, 35 are folded into a Z-shaped position (FIG. 2). In this case, the webs 34, 35 butt against the rearside of the box front wall 13. The ifolding line 39, which is at the top following the folding operation, is flush with the transverse edge 40. The folding line 38 is located at a distance therebeneath. The webs 34, 35 are dimensioned such that, in this folded position (FIG. 2), the entire collar 12 has been moved, relative to the main blank 33, into the position appropriate for the pack.

In order at least partially to avoid a three-layered arrangement in the region of the folded webs 34, 35, the collar front wall 30 is provided, in the region of the webs 34, 35, with a cutout 41, 42 which is produced by punching. The cutouts 41, 42 are positioned, configured and dimensioned such that a (top) part of the folded webs 34, 35 passes into the associated cutout 41, 42 (FIG. 2). This gives in said top region of the webs 34, 35, a two-layered design, as is the case elsewhere where the collar front wall 30 butts against the box front wall 13.

In the case of the present exemplary embodiments, the cutouts 41, 42 are of rectangular design, preferably of slightly greater width than that of the webs 34, 35.

Further details of the configuration of the blank according to FIG. 3 are also designed in accordance with the special features of the present hinge-lid box. For example, the overall width 43 of the blank is greater (e.g. 98 mm) than the collar width 44 (95 mm). The wall width 45 is, for example, 55 mm. The width of the webs 34, 35 may be 6 mm and that of the associated cutouts 41, 42 6.5 mm. The web length 46 (from folding line 38 to folding line 39) is 7.5 mm in FIGS. 1 to 3. A distance 47 between the folding line 38 (which was originally at the top) and a remote border of the cutout 41, 42 is provided as being 7 mm. The distance between the folding line 38 and the facing border of the cutout 41, 42 is approximately 3 mm here.

A further special feature in terms of the configuration of the blank is that there is a clear distance of at least 2 mm between an oblique edge 48 of the outer box side tab 25 and a corresponding oblique edge 49, as bottom boundary of the collar side tab 31, 32. This produces a free interspace 50, which extends as far as an outer border of the respectively associated web 34, 35. This renders more precise folding possible. In particular, the situation where the collar side tabs 31, 32 catch on the box side tabs 25 during folding of the webs 34, 35 and of the collar 12 is avoided.

In the folded position (FIGS. 1, 2), the collar 12 is connected to the box part 10. In the case of the present exemplary embodiment, the region of the collar front wall 30 is provided with spots of glue, to be precise two spots of glue 51, 52, approximately level with the cutouts 41, 42. The collar front wall 30 is anchored on the inside of the box front wall 13 with the aid of these spots of glue 51, 52. In the case of this exemplary embodiment, the webs 34, 35 are expediently also anchored in the folded position (in particular FIG. 2) by adhesive bonding. The webs 34, 35 may be fixed by adhesive bonding to the facing, inner side of the box front wall 13.

Figure 5:
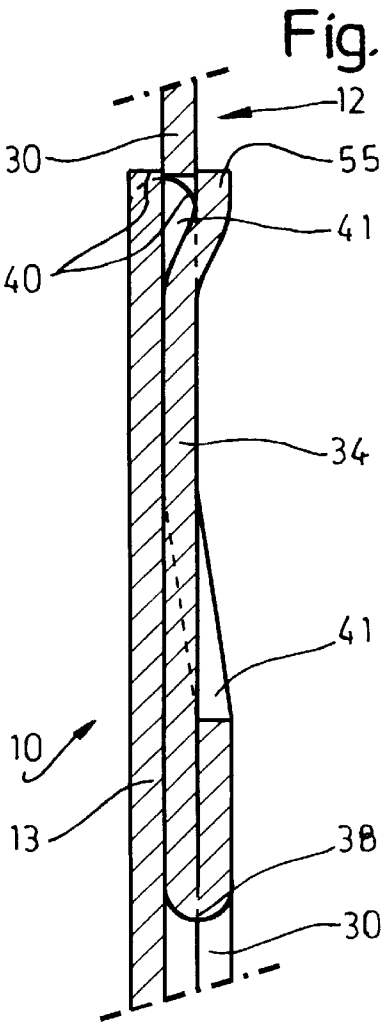
FIG. 5 shows a detail, analogous to FIG. 2, in the section taken along section plane V—V of FIG. 4.
Figure 4:
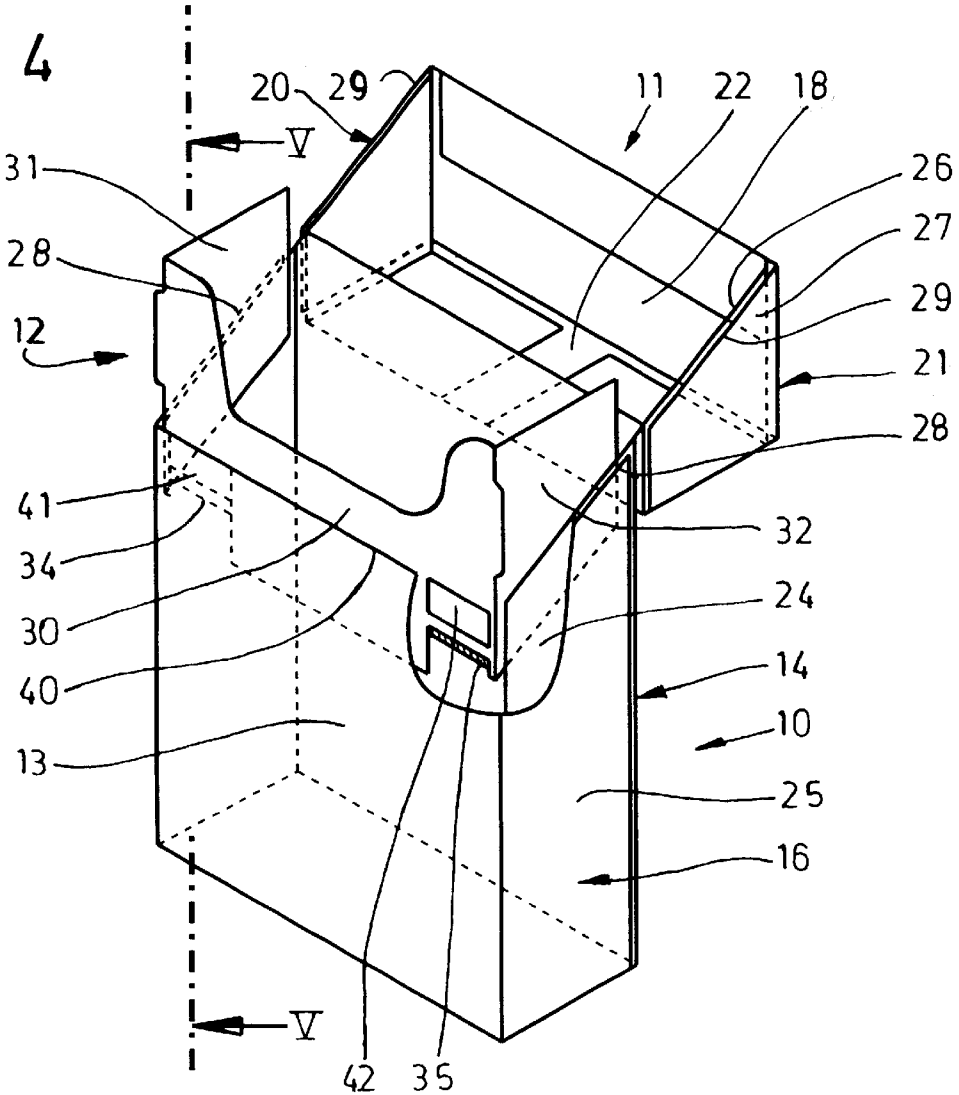
FIG. 4 shows an illustration, analogous to FIG. 1, of another design of a hinge-lid box.
Figure 6:
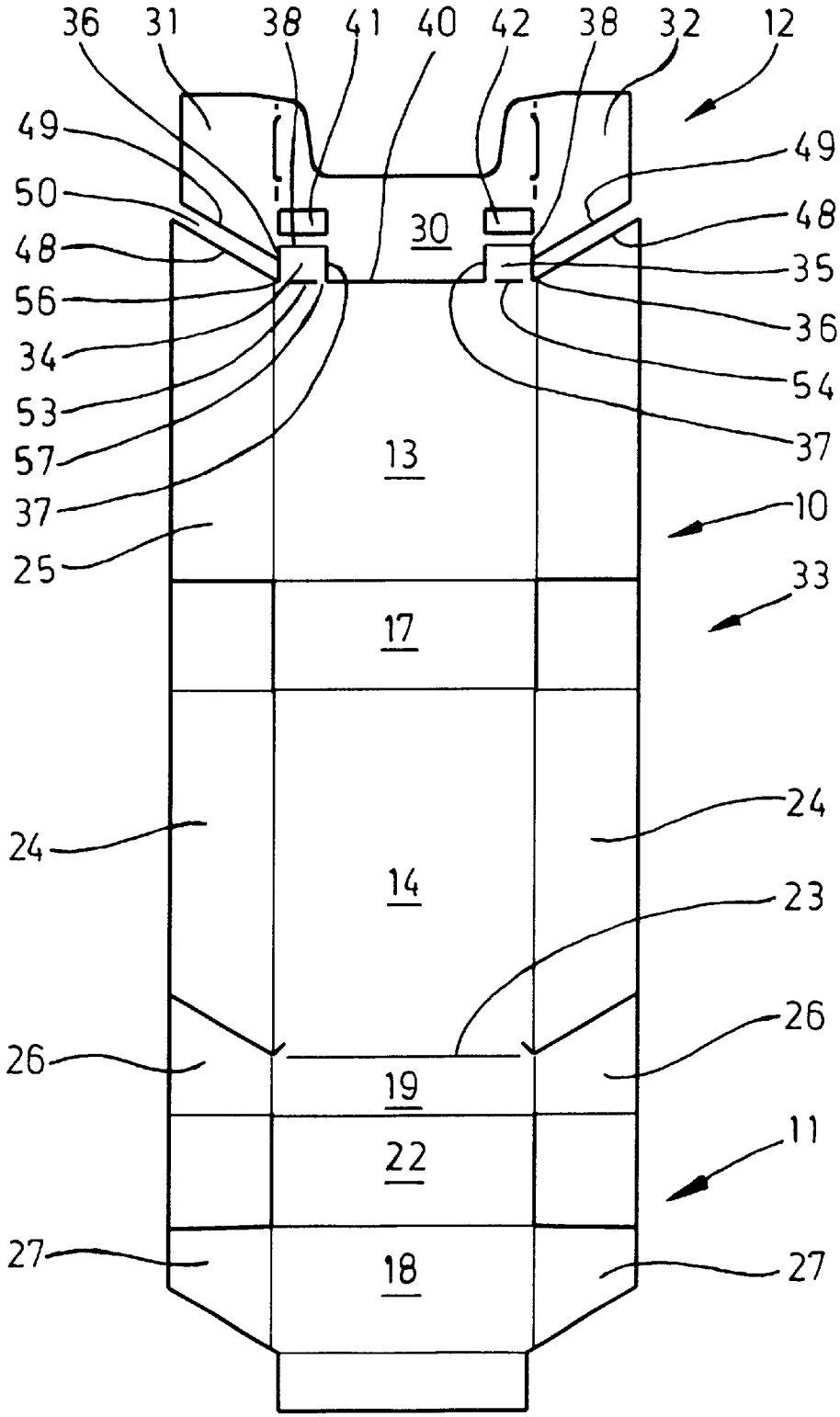
FIG. 6 shows a spread-out blank for a hinge-lid box according to FIG. 4.

A further special feature is realized in the case of the hinge-lid box according to FIGS. 4, 5 and 6. In this version, the webs 34, 35 are wider than in the case of the exemplary embodiment of FIGS. 1 to 3. Correspondingly, the cutouts 41, 42 are also dimensioned to be of a greater width, that is to say they are slightly wider than the webs 34, 35. In the longitudinal direction of the blank, the cutouts 41, 42 are of smaller dimensions, namely are considerably shorter than the webs 34, 35.

The webs 34, 35 are separated off from the main blank 33 or from the box front wall 13 by folding lines 39, which are an extension of the transverse edge 40. The opposite folding line, which faces the cutout 41, 42, is modified. A preferably centrally arranged severing cut 53, 54 in the region of the (imaginary) folding line bounds a top end edge 55 of the web 34, 35. The end edge 55 extends between narrow, lateral residual webs 56, 57. A folding line which corresponds to the folding line 38 runs in the region of said residual webs 56, 57.

When the collar 12 is in the folded position, at least a top region of the web 34, 35 passes through the associated cutout 41, 42. In the region of the severing cut 53, 54, the resulting end edge 55 or a facing region of the web 34, 35 butts against the rear side or inside of the collar front wall 30 (FIG. 5). This produces a clamping effect. The web 34, 35 is anchored on the collar by the clamping positioning of the top region. Additional adhesive bonding of the web 34, 35 in the folded position (to the box front wall 13) may be provided, but is dispensed with in the case of the exemplary embodiment according to FIGS. 4 to 6.

Figure 1:
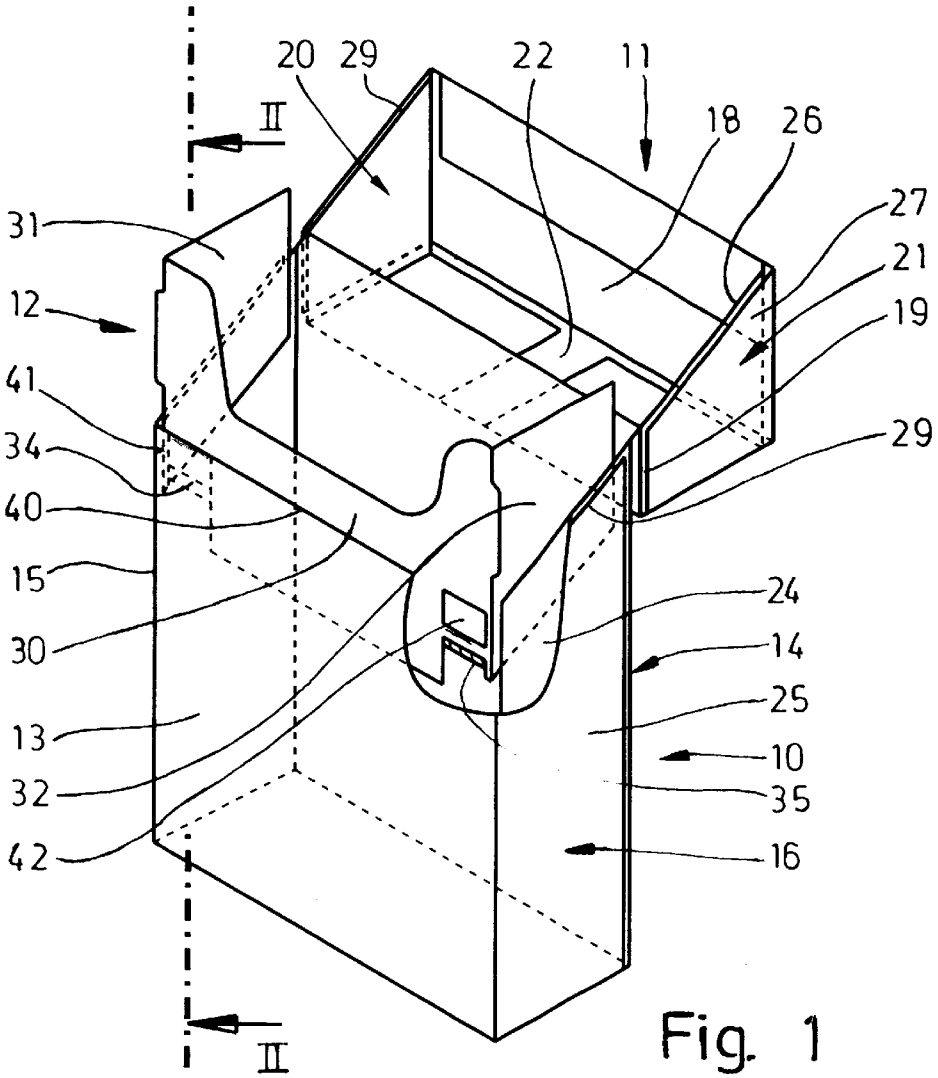
FIG. 1 shows a perspective illustration, which is partially cut away, of a hinge-lid box with the lid open.

In other respects, the hinge-lid box and blank of this exemplary embodiment correspond to that of FIGS. 1 to 3.

Figure 8:
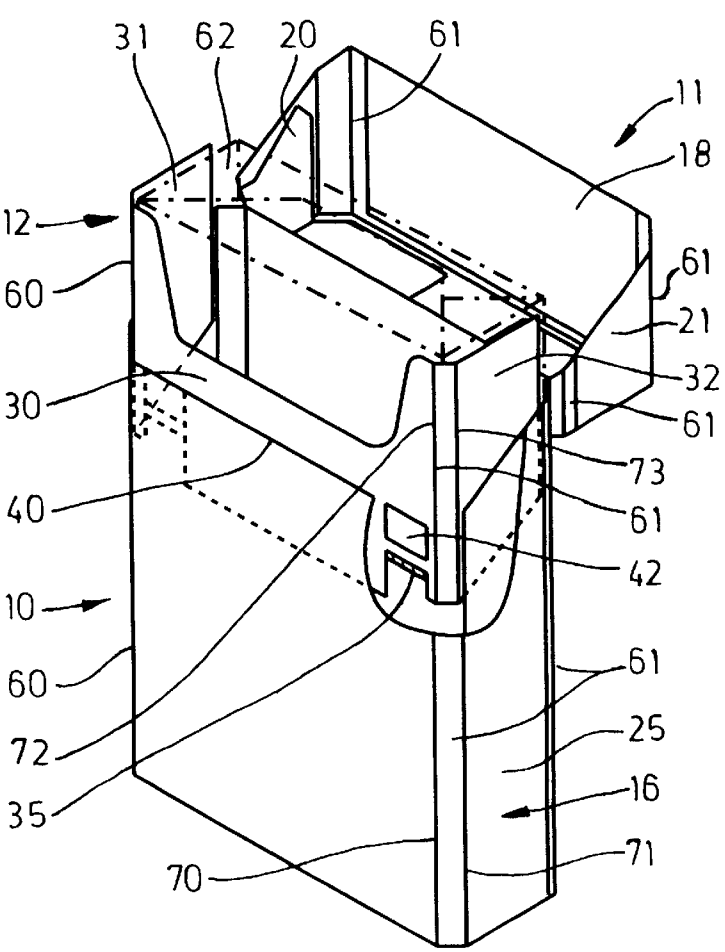
FIG. 8 shows an illustration of a hinge-lid box analogous to FIG. 7 with bevelled upright pack edges or with an octagonal cross-section.
Figure 7:
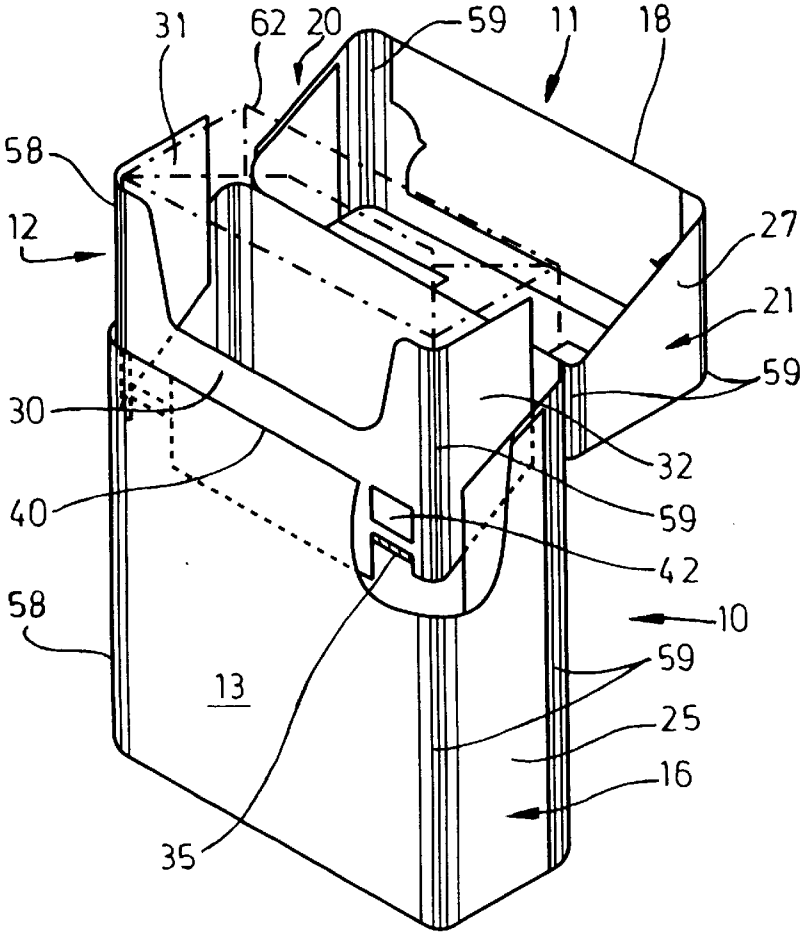
FIG. 7 shows an illustration analogous to FIG. 1 for a hinge-lid box with rounded upright pack edges.

FIGS. 7 and 8 show specially designed hinge-lid boxes, namely ones with rounded longitudinal edges, that is to say round edges 58, 59 (FIG. 7), or with bevelled edges, that is to say oblique edges 60, 61 (FIG. 8). These types of pack are known in principle. The special feature is in the use of single-piece blanks for these types of pack and in the further special features which result therefrom. FIGS. 7 and 8 each show a cigarette block 62 (in chain-dotted lines) as an example of pack contents. Said cigarette block comprises a cigarette group which is enclosed by an inner wrapper, namely a tin-foil or paper blank.

Both hinge-lid boxes (FIGS. 7, 8) comprise single-piece blanks. The collar 12 is connected to the main blank 33 via webs 34, 35 in each case. In the case of the exemplary embodiments shown, the cutouts 41, 42 are also provided, although it is likewise possible for them to be dispensed with. Furthermore, the blanks may be designed in accordance with the details described in conjunction with FIGS. 4 to 6.

Figure 9:
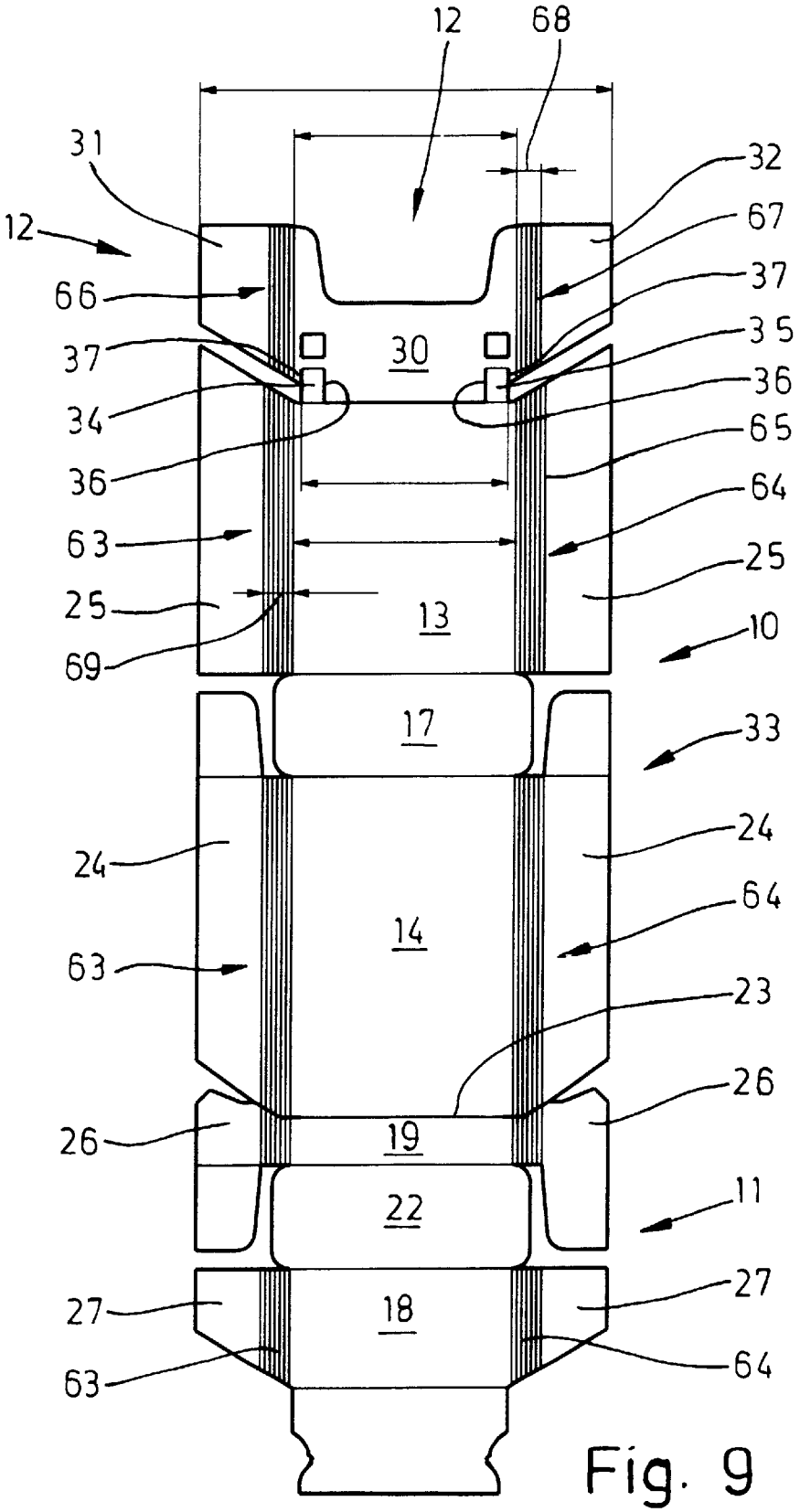
FIG. 9 shows a spread-out blank for a hinge-lid box according to FIG. 7.

An advantageous embodiment of a blank for a hinge-lid box according to FIG. 7 is shown in FIG. 9. The round edges 58, 59 are defined by folding strips 63, 64 which separate off a central region of the main blank 33 from lateral folding tabs, that is to say box front wall 13, box rear wall 14, base 17, lid front wall 18, lid rear wall 19 and end wall 22, on the one hand, from the box side tabs 24, 25 and lid side tabs 26, 27, on the other hand. In terms of width, the folding strip 63, 64 corresponds to the dimensioning of the round edges 58, 59. The folding strip 63, 64 comprises grooves 65 which run parallel, and at a small distance from one another, in the longitudinal direction of the blank. The grooves 65 are provided by appropriate stamping tools in the packaging machine or outside the latter.

Since the collar 12 has round edges 58, 59 as well, folding strips 66, 67 are also provided in the region of the collar 12, to be precise preferably simultaneously with the folding strips 63, 64 in the region of the main blank 33. The special feature is that the folding strips 63, 64, on the one hand, and 66, 67, on the other hand, run flush on the mutually facing sides. Towards the outside, that is to say towards the collar side tabs 31, 32, the folding strips 66, 67 of the collar 12 are of a smaller width 68 than the width 69 of the folding strips 63, 64. The dimensioning expediently differs by one groove 65.

In the case of this type of hinge-lid box, the webs 34, 35 are positioned such that the outer punch cuts 37 are at a (small) distance from the facing grooves 65 or folding strips 63, 64 or 66, 67. This distance may be 1.5 to 2 mm, and ensures that the grooves of the folding strips 63, etc. do not run in the region of the webs 34, 35.

Furthermore, the blank according to FIG. 9 is designed such that rounded corners allow the base 17 and end wall 22 to match with the shape of the round edges 58, 59. It is only in the region outside the round edges 58, 59 that the box side tabs 24 and 25 and the lid side tabs 26 and 27 butt against one another or overlap one another. Said side tabs are connected to one another by adhesive bonding in said region.

Figure 10:
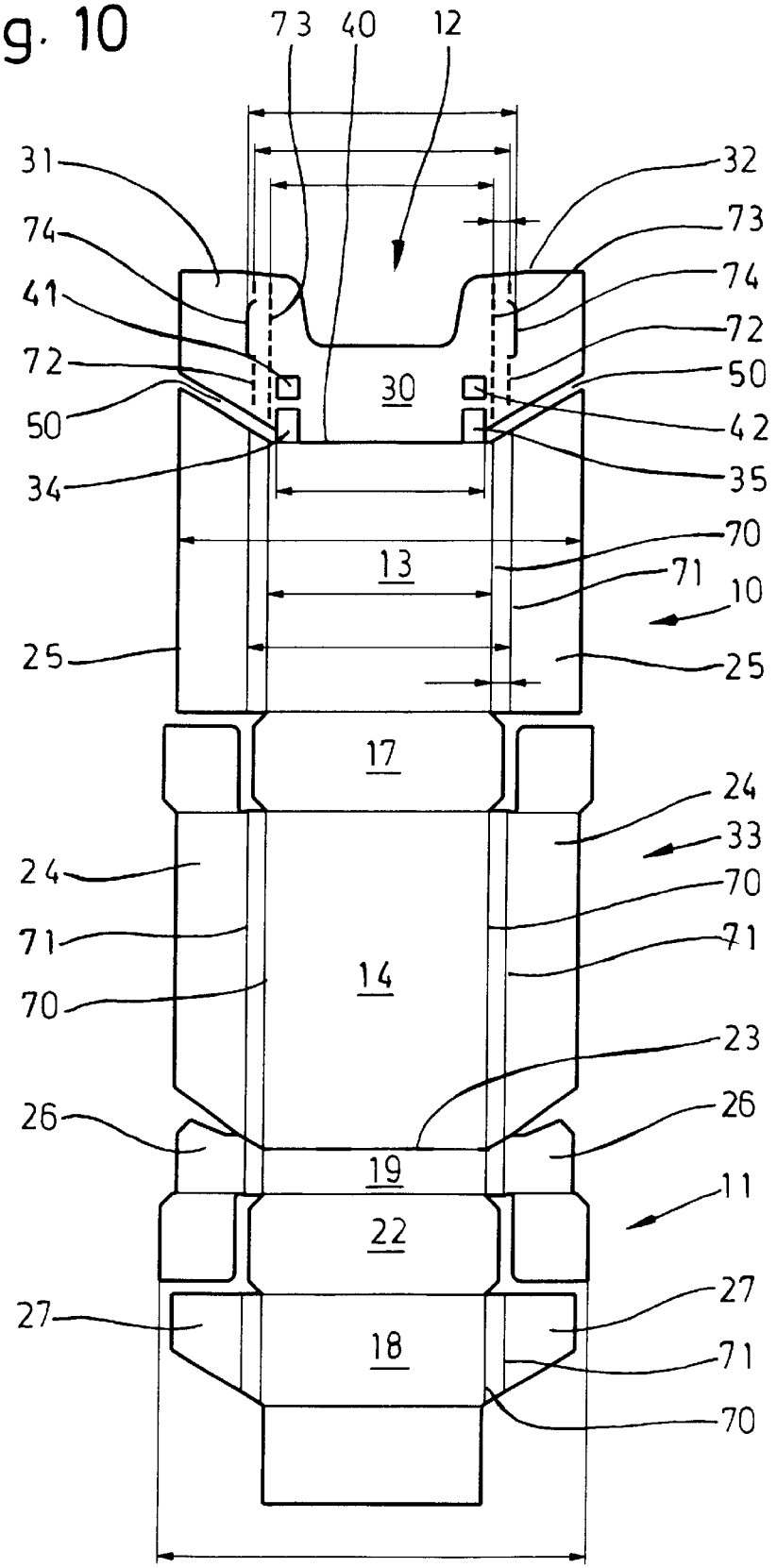
FIG. 10 shows a spread-out blank for a hinge-lid box according to FIG. 8.

Analogously, the blank according to FIG. 10 is designed for a hinge-lid box with oblique edges 60, 61. In order to produce these oblique edges 60, 61, two parallel folding lines 70, 71 are formed in the region of the blank. Said folding lines extend over the entire region of the main blank 33, including the lid. The collar 12 is likewise coordinated with the (octagonal) cross-sectional configuration of the pack. Two parallel folding lines are provided for the purpose of separating off the collar front wall 30 from the collar side tabs 31, 32. These folding lines, however, are parallel perforation lines 72, 73. The respectively outer perforation lines 72 are interrupted in a top or outer region by a C-shaped punching 74. The latter forms in each case a protrusion or overhang of the collar on the front side of the pack so that the lid 11 can be fixed in the closed position. The perforation lines 72, 73, as predefined folding lines in the region of the collar 12, are arranged such that the inner perforation lines 73 are spaced apart from one another by a smaller distance than the inner, mutually facing folding lines 70. For example, the distance between the folding lines 70 may be 51.3 mm and the distance between the perforation lines 73 may be 50.3 mm. This then gives the position for the outer perforation lines 72. The distance between the latter and the respectively adjacent inner perforation line 73 may be 7.9 mm and the distance between the two mutually associated folding lines 70, 71 8.9 mm. Consequently, the outer folding lines 71 are offset outwards with respect to the outer perforation lines 72.

Figure 11:
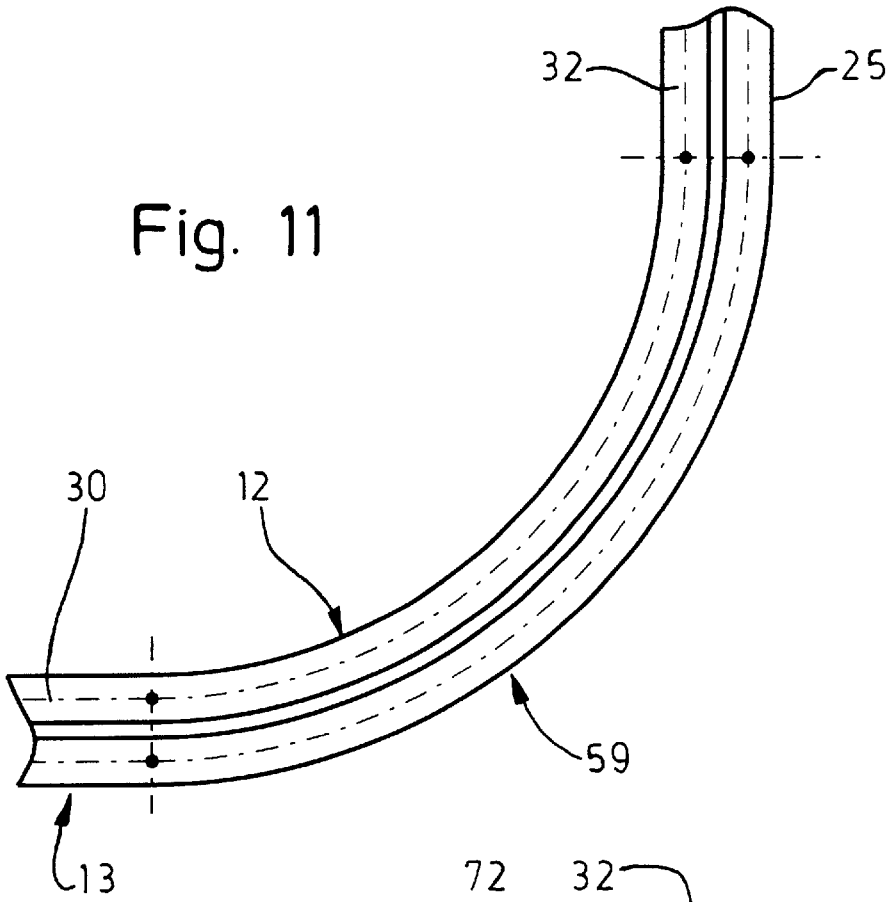
FIG. 11 shows, on a vastly enlarged scale, a horizontal section of a detail of a hinge-lid box according to FIG. 7 in the collar/box-part region.
Figure 12:
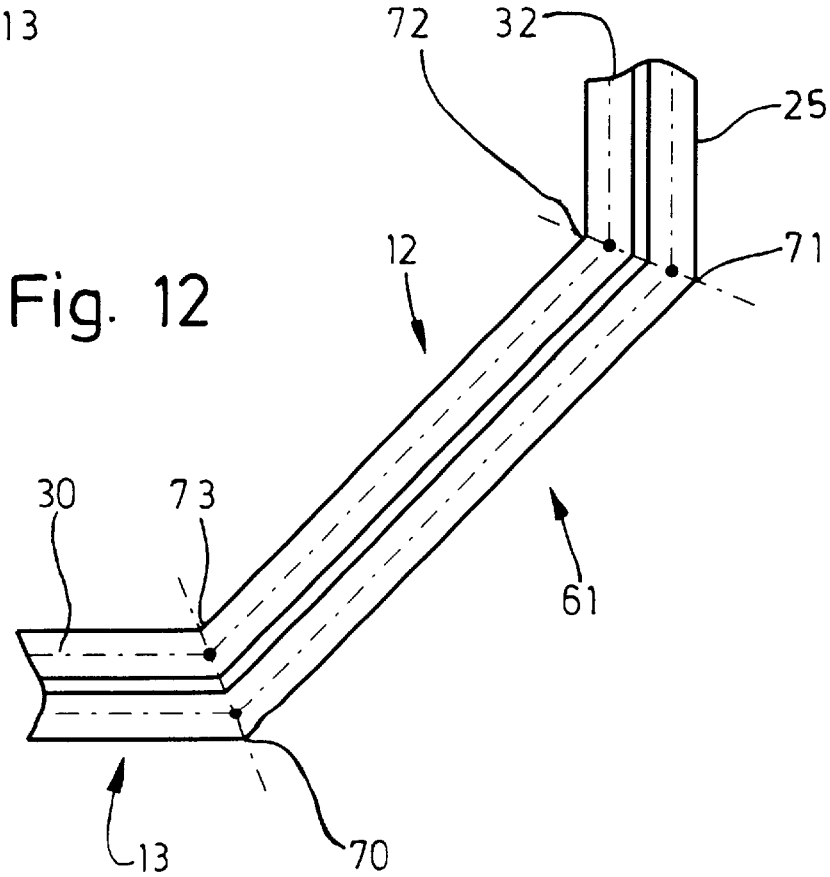
FIG. 12 shows an illustration analogous to FIG. 11 for the hinge-lid box according to FIG. 8.

These geometrical interrelationships mean that adjacent walls run as shown in FIGS. 11 and 12. FIG. 11 shows a detail of the pack according to FIG. 7 in the region where the collar 12 and box front wall 13 overlap. The quarter-circle regions of the box front wall 13 and collar 12 are located concentrically with respect to one another, that is to say with the same (imaginary) centre point. This effect is ensured by the above described dimensions. Accordingly, in the region of the collar 12, the round edge 58, 59 is of a smaller diameter than that of the box front wall 13.

The hinge-lid box according to FIG. 8 is of analogous design in this region. (Upright) edges of the box front wall 13 formed by the folding lines 70, 71 are on a line with the edges formed by the perforation lines 72 and 73.

In other respects, the hinge-lid boxes according to FIGS. 7 to 12 may be designed in a known manner and/or with all the details of the hinge-lid boxes according to FIGS. 1 to 6, namely in terms of the connection of the collar 12 to the main blank 33.

| List of Designation |
|---|
| 10 Box part |
| 11 Lid |
| 12 Collar |
| 13 Box front wall |
| 14 Box tear wall |
| 15 Box side wall |
| 16 Box side wall |
| 17 Base |
| 18 Lid front wall |
| 19 Lid rear wall |
| 20 Lid side wall |
| 21 Lid side wall |
| 22 End wall |
| 23 Articulation line |
| 24 Inner box side tab |
| 25 Outer box side tab |
| 26 Inner lid side tab |
| 27 Outer lid side tab |
| 28 Closing edge |
| 29 Closing edge |
| 30 Collar front wall |
| 31 Collar side tab |
| 32 Collar side tab |
| 33 Main blank |
| 34 Web |
| 35 Web |
| 36 Punch cut |
| 37 Punch cut |
| 38 Folding line |
| 39 Folding line |
| 40 Transverse edge |
| 4i Cutout |
| 42 Cutout |
| 43 Overall width |
| 44 Collar width |
| 45 Wall width |
| 46 Web length |
| 47 Distance |
| 48 Oblique edge |
| 49 Oblique edge |
| 50 Interspace |
| 5i Spot of glue |
| 52 Spot of glue |
| 53 Severing cut |
| 54 Severing cut |
| 55 End edge |
| 56 Residual web |
| 57 Residual web |
| 58 Round edge |
| 59 Round edge |
| 60 Oblique edge |
| 6i Oblique edge |
| 62 Cigarette block |
| 63 Folding strip |
| 64 Folding strip |
| 65 Groove |
| 66 Folding strip |
| 67 Folding strip |
| 68 Width |
| 69 Width |

-continued

| List of Designation |
|---|
| 70 Folding line |
| 71 Folding line |
| 72 Perforation line |
| 73 Perforation line |
| 74 Punching |

What is claimed is:

1. A hinge-lid box for cigarettes, comprising a single-piece foldable blank made of thin cardboard for forming a box part (10) with a box front wall (13), a box rear wall (14), box side walls (15, 16) and a base (17), and for forming a lid (11) with a lid front wall (18), a lid rear wall (19), lid side walls (20, 21) and an end wall (22), and also for forming a collar (12) comprising a collar front wall (30) and collar side tabs (31, 32), the collar (12) being connected, in a region of the collar front wall (30), to the box front wall (13) via connection webs (34, 35) which arc formed in the blank and which, when the blank is folded, are folded in a Z-shaped manner such that the connection webs (34, 35) butt against an inside surface of the box front wall (13), and such that the collar front wall (30) butts against the folded connection webs (34, 35), characterized in that the collar front wall (30) has, in a region of the connection webs (34, 35), cutouts (41, 42) into which respective ones of the connection webs (34, 35) at least partially pass.

2. Hinge-lid box according to claim 1, characterized in that the cutouts (41, 42) are of square or rectangular design and are arranged, in a region of the collar front wall (30), directly above the connection webs (34, 35), the cutouts (41, 42) being slightly wider than the respectively associated web (34, 35).

3. Hinge-lid box according to claim 2, characterized in that, formed between box side tabs (25), as outer layers of the box side walls on the one hand, and adjacent collar side tabs (31, 32) on the other hand, is an interspace (50) which extends as far as a facing border of the webs (34, 35).

4. Hinge-lid box according to claim 1, characterized in that a folding line (39), formed between each of the connection webs (34, 35) and the box front wall (13), is provided with a severing cut (53, 54), which extends over a central sub-region of the folding line (39) such that residual additional webs (56, 57) remain for the purpose of connecting the connection webs (34, 35) to the box front wall (13), and in that when the collar and the connection webs (34, 35) have been folded, an end edge (55) of each connection web (34, 35) passes through the respective cutout (41, 42) and butts against an inside surface of the collar front wall (30).

5. Hinge-lid box according to claim 1, characterized in that the collar front wall (30) is fastened on the inside surface of the box front wall (13) by spots of glue (51, 52), approximately level with the cutouts (41, 42).

6. Hinge-lid box according to claim 1, characterized by upright round edges (58, 59) or oblique edges (60, 61), the collar (12) being connected to the box front wall (13) via the webs (34, 35) which are arranged at a small distance from the adjacent round edges (58, 59) or oblique edges (60, 61).

7. Hinge-lid box according to claim 6, characterized in that, in a blank for the round edges (58, 59), folding strips (63, 64), made of grooves (65) for forming the round edges (58, 59), are slightly greater in width than folding strips (66, 67) in a region of the collar (12) between the collar front wall (30) and the collar side tabs (31, 32), wherein the folding strips (63, 64), on the one hand, and the folding strips (66, 67), on the other hand, run flush on the mutually facing sides.

8. Hinge-lid box according to claim 6, characterized in that, in the blank for oblique edges (60, 61), first strips which are bounded by parallel folding lines (70, 71) are defined in a region of a main blank (33), and also defined are second strips which are bounded by folding lines or perforation lines (72, 73) in a region of the collar (12), said first and second strips respectively forming the oblique edges (60, 61), and in that the folding lines (70, 71) in the region of the main blank (33) are spaced apart from one another by a greater distance than the folding lines or perforation lines (72, 73) in the region of the collar (12).

9. Hinge-lid box according to claim 8, characterized in that the folding lines or perforation lines (72, 73) are offset inwards with respect to the folding lines (70, 71) which are arranged on a same side.

* * * * *